US006172617B1

(12) United States Patent
Bullock

(10) Patent No.: US 6,172,617 B1
(45) Date of Patent: Jan. 9, 2001

(54) CONTROLLER INTERFACE DEVICE

(75) Inventor: Darcy M. Bullock, Lafayette, IN (US)

(73) Assignee: Louisiana State University, Baton Rouge, LA (US)

( * ) Notice: Under 35 U.S.C. 154(b), the term of this patent shall be extended for 0 days.

(21) Appl. No.: 09/108,833

(22) Filed: Jul. 2, 1998

(51) Int. Cl.[7] ..... G08G 1/07

(52) U.S. Cl. ..... 340/909; 340/910; 340/916; 340/917; 701/117; 701/118; 701/120

(58) Field of Search ..... 340/909, 910, 340/916, 917; 701/117, 118, 120

(56) References Cited

U.S. PATENT DOCUMENTS 5,646,853 * 7/1997 Takahashi et al. ..... 701/118

* cited by examiner

*Primary Examiner*—Julie Lieu

(74) *Attorney, Agent, or Firm*—Otto M. Wildensteiner

(57) ABSTRACT

An interface device between a computer running a traffic simulation program and any number of traffic signal controllers. The traffic simulation program simulates traffic in a road network including signal-controlled intersections. There are many signal manufacturers and they do not release the details of the control algorithms used in their controllers, hence it is impractical if not impossible to merely insert the control algorithm for a given controller into the program. The interface of the present invention allows any controller from any manufacturer to be used with the simulation program so that traffic flow in any network including signal-controlled intersections can be simulated. An assumed traffic network and demand traffic is input into the program; the program sends detector actuations to the signal controllers via the interface device and the controllers's phase indication states are sent back into the program also via the controller. The program then integrates this feedback into its operation and simulates the way traffic will flow through the road network having intersections with these particular signal controllers.

5 Claims, 2 Drawing Sheets

Figure 1: Prior Art

CONTROLLER INTERFACE DEVICE

STATEMENT OF GOVERNMENT INTEREST

The present invention may be made or used by or for the Government of the United States without the payment of any royalties thereon or therefor.

BACKGROUND

The traffic signal system community is lacking two major tools necessary for planning and operating state of the art traffic signal systems. First, there needs to be a rational procedure for quantifying the benefits associated with various traffic signal system improvements. Often, during the planning stage of a signal system upgrade many of the anticipated benefits are based upon percentage reductions in travel time, emissions, or delays observed in other systems. However, rarely are the systems so similar that these percentage reductions in measures of effectiveness (MOEs) are transferable. Furthermore, if a rational engineering economy-based decision model is followed, system costs and anticipated benefits should be tabulated to compute the net present value of benefits minus costs for a variety of alternatives such as 1) status quo, 2) coordinated fixed time system, 3) coordinated actuated-control system, 4) proprietary closed loop system, and, perhaps, 5) a new adaptive control model. Life cycle system costs are relatively simple to estimate. However, estimating the operational benefits can be quite difficult. Software packages such as CORSIM permit engineers to deterministically quantify benefits associated with cases 1, 2, and 3 for a particular study area. However, due to the large number of traffic signal system vendors, it is impossible to imagine CORSIM software developers ever implementing all the features necessary to model all the possible systems associated with cases 4 and 5. Therefore, there is a need for a systematic procedure to evaluate the benefits of control algorithms that are not available in the CORSIM environment.

Second, there needs to be a mechanism for tuning a new signal system off-line before it is deployed in the field. Modern traffic signal controllers have hundreds of different parameters that can be adjusted to improve system performance for a particular deployment. However, since traffic demand is stochastic and varies from day to day, there is no way to deterministically evaluate the performance gains or losses associated with parameter changes. Further, the political impact of making a mistake during an on-line tuning process leads to the fact that most modern closed-loop systems are deployed with many of their sophisticated traffic-responsive features non-operational. This is because traffic engineers cannot be certain of the performance of many of the newer adaptive features of closed loop systems and are unwilling to take the risk of attempting to make them functional.

Based on these observations, it is clear that a systematic evaluation procedure must be developed for evaluating and tuning traffic signal controllers before they are deployed on the street. It is currently possible to set up a complete closed loop system in a laboratory or signal shop environment with switch boxes (commonly referred to as a suitcase controller) connected to each controller. This type of test environment allows engineers to verify that desired controller features are operating as expected. However, to actually simulate all the discrete detector actuations that would be associated with a small three intersection arterial highway would be impossible for even small traffic volumes, much less with corridors with more signals or higher traffic volumes. Furthermore, it would be impossible to quantify the performance of such a simulation in terms of vehicle travel time or delay. Alternatively, if a testing environment could be set up where a computer operated the switch boxes and kept track of vehicle movements throughout a system, quantitative performance measurements could be obtained.

OBJECTS OF THE INVENTION

Accordingly, it is an object of the present invention to provide a means for introducing actual traffic signal controller hardware into a traffic simulation or automated testing computer program.

It is a further object to allow the introduction of any traffic signal controller hardware into a traffic simulation or automated testing program.

SUMMARY

Briefly, the present invention is a means and method of allowing traffic engineers to introduce actual traffic signal controller hardware into a traffic simulation program. This is done by running a traffic simulation program (for example CORSIM, a program developed and distributed by the Federal Highway Administration of the Department of Transportation) on a computer. The program sends signals to the traffic signal controller through the computer's serial port into the interface device of the present invention which converts these signals into the voltages that are used to interface with the traffic signal hardware. These signals are stochastically generated by CORSIM in response to a desired schedule that is one of the program's inputs. The response of the traffic signal hardware to these signals, i.e. its phase change from green to amber to red, is then fed back into the computer that is running CORSIM through the serial port and integrated into that program to control the simulated traffic. In this way the hardware is made a part of the simulation program. If the algorithms in the traffic signal hardware were known, they could be input directly into CORSIM. However, there are many different hardware manufacturers and they do not release the details of their algorithms; thus the present interface device had to be devised to get around this problem. Since all traffic control devices utilize voltages as control inputs, the present interface device will work with all traffic control devices.

DESCRIPTION OF THE PREFERRED EMBODIMENT

Figure 1:
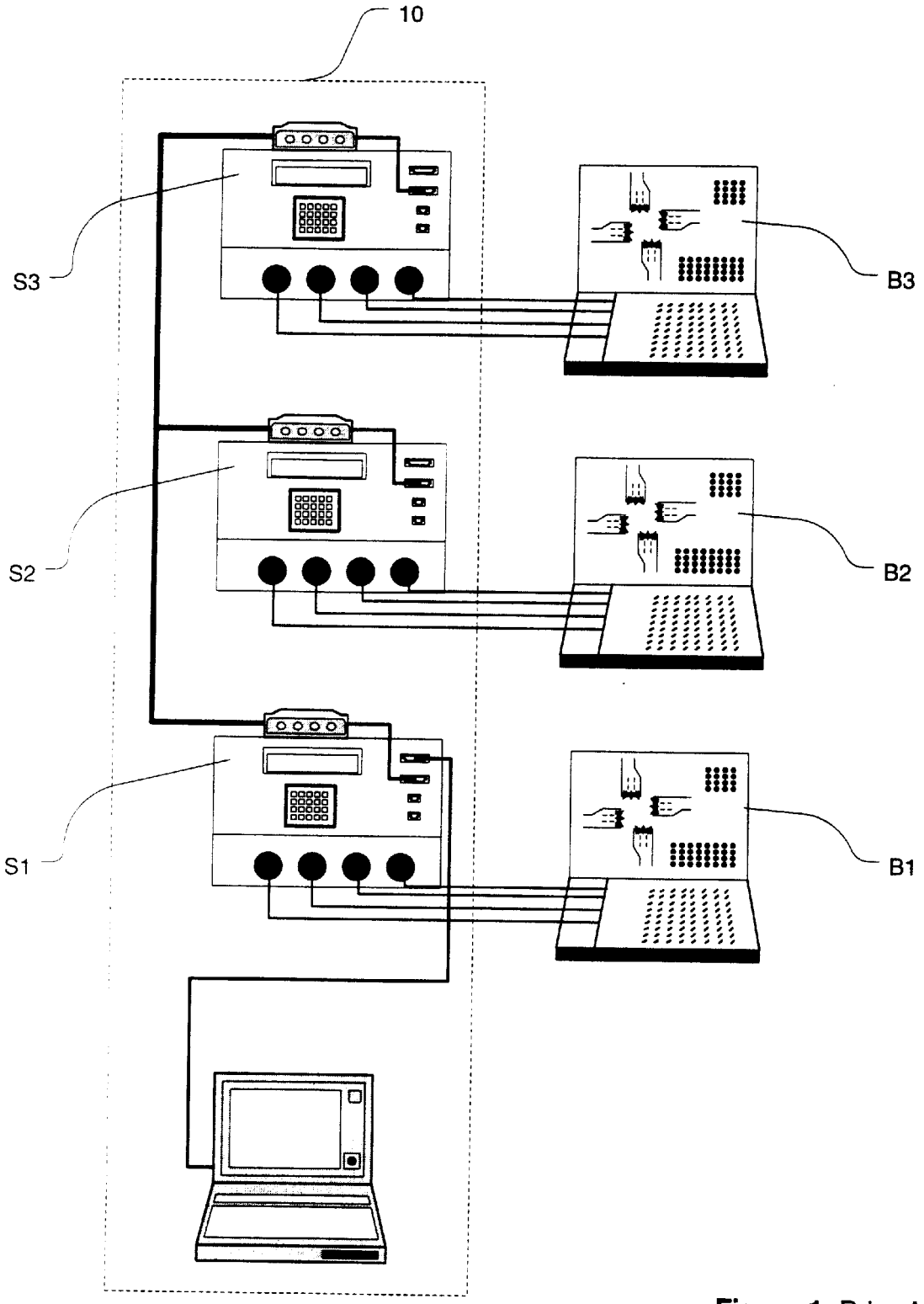
FIG. 1 shows the prior art method of testing traffic signal controllers.

It is currently possible to set up a complete closed loop system in a laboratory or signal shop environment with switch boxes $B_1$–$B_3$ connected to controllers $S_1$–$S_3$ as shown in FIG. 1. This type of test environment allows engineers to verify that desired controller features are operating as expected. However, to actually simulate all of the discrete detector actuations that would be associated with even a small three intersection arterial, like the one shown in FIG. 1, would be impossible for even small traffic volumes, much less corridors with more signals or high volumes. Furthermore, it would be impossible to quantify the performance of such a simulation in terms of vehicle travel time or delay. Quantitative performance measurements could be obtained, however, if a testing environment could be set up where a computer operated the switch boxes and kept track of vehicle movements throughout a simulated sytem.

Figure 2:
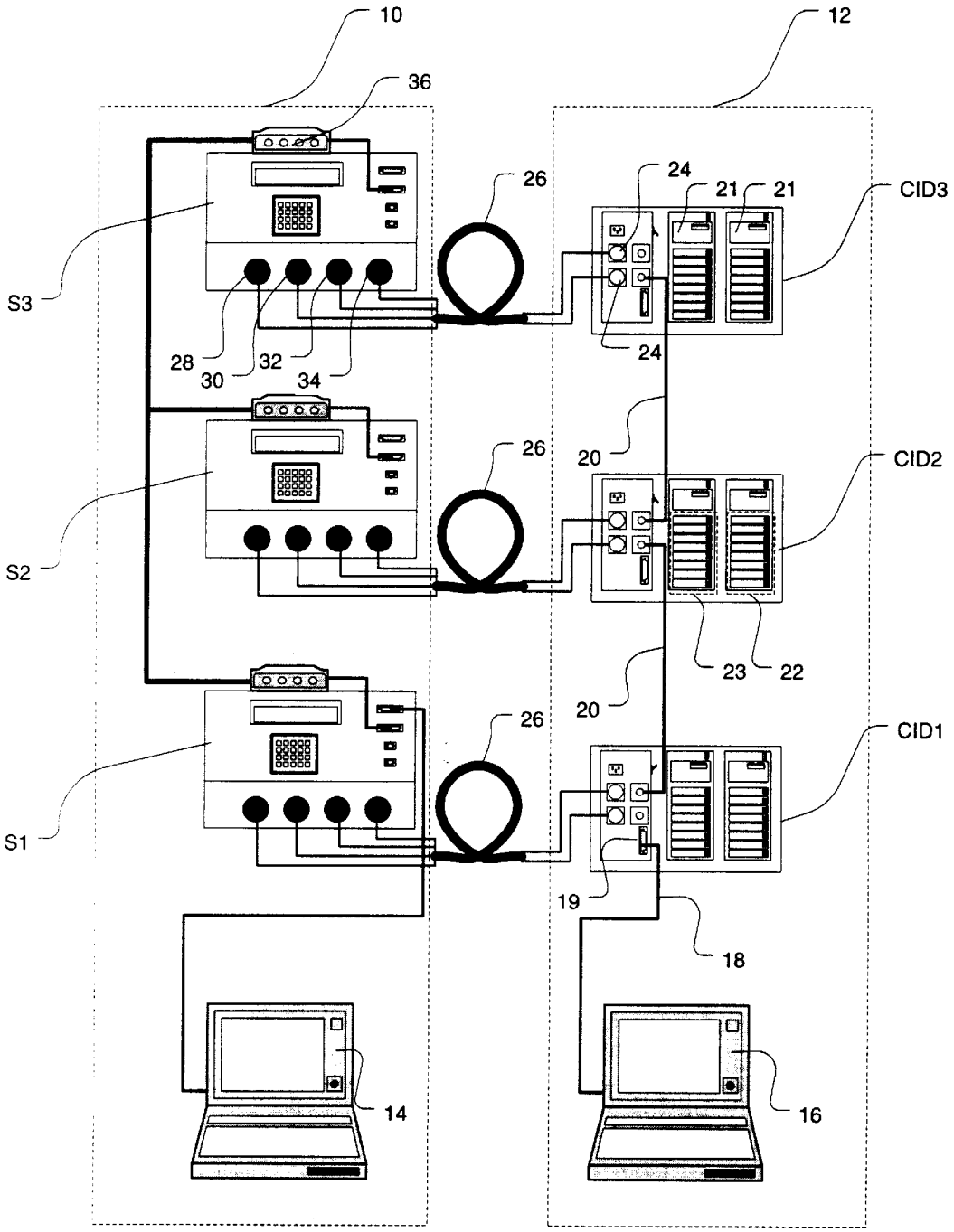
FIG. 2 shows an overall diagram of the present invention for simulating three signal-controlled intersections.

FIG. 2 shows such an environment for simulating a section of highway having three intersections controlled by signal lights. Signal light controllers $S_1$–$S_3$ are connected together in network 10 as in the prior art and controller interface devices of the present invention $CID_1$–$CID_3$ are connected together in network 12. Each signal light controller is connected to a controller interface device of the present invention.

Computer 14 is usually present and runs the software supplied by the traffic signal controller manufacturer as in the prior art. Computer 16 runs CORSIM, a computer program written and distributed by the Federal Highway Administration of the Department of Transportation. If computer 14 is not present CORSIM can still be run, but the simulation will not include all of the functions of the controllers.

CORSIM is an FHWA-sponsored computer simulation model that has been evolving since the early 1970s. The purpose of CORSIM is to allow a discrete time simulation with a resolution of 1 second to be run on a user-defined traffic network (both freeways and signalized arterials). During each time step, vehicle accelerations are recomputed based on car-following theory, and vehicle kinematic equations are applied to update the velocity and position of each vehicle in the network. Since the position and velocity of every vehicle in the system is known for every time interval (i.e. each second), CORSIM is able to tabulate measures of efficiency (MOE) such as average speed, percent stops, delay time, emissions, and trips for all links and turning movements. These quantitative values are then useful for objectively comparing before and after studies when evaluating the impact of a new traffic signal timing plan, for example. CORSIM also has an animation viewer that allows the user to view the position of icons representing individual vehicles as they move through the network.

In its current form CORSIM allows very detailed modeling of roadway networks and provides a mechanism for defining turning pockets, lane striping, one-way streets, two-way streets, freeway interchanges, link speeds, demand volumes, proportion of trucks, and vehicle and driver operating characteristics. It also provides parameters for defining a basic actuated traffic signal controller. However, the field of traffic signal systems is continually evolving, with vendors continuing to add new features they consider proprietary.

In an ideal world, the CORSIM package would also have all algorithms and parameters that are used by all the different traffic controller vendors. However, the reality is that CORSIM models only the most common features available in traffic control systems. The spirit of specifications such as NEMA TS1 and TS2 is that the detector inputs and phase outputs are standardized, and vendors compete by adding software features. Unfortunately, traffic signal vendors do not release the details of these proprietary software features. This has resulted in traffic signal controllers being available to the traffic engineer that have numerous control parameters and algorithms that cannot be modeled in CORSIM. Since software development is extremely costly, it is unlikely that CORSIM will ever reach the point where it has the capability of simulating all these features.

In control systems engineering terminology, both the controller (CORSIM signal algorithms) and the plant (CORSIM microscopic simulation environment) are running on the same computer. The interface (phase indications and detector actuations) between the plant and the controller correspond exactly to the interface between an NEMA controller (plugs A, B, C and D) and the traffic signal load switches, loop detectors, and peripheral interface devices such as railroad preempts. Therefore it would be convenient to unplug the CORSIM signal control algorithms and replace them with the control algorithms in the controller. Since the CORSIM package is designed to run in a personal computer environment and the various traffic signal controllers run on a variety of single board computers, the most convenient standard mechanism for interfacing the CORSIM simulation environment to an external controller is to use the 24 volt logic interface specified in NEMA TS2 (Sections 3.3.5.1.3 and 3.3.5.1.4) or FHWA-IP-78-16 if a 170 type controller is used. This type of interface requires CORSIM to send an electrical pulse to the corresponding controller detector input every time a vehicle crosses a vehicle detector (assuming pulse mode) and to monitor the phase indication outputs of the controller to determine which traffic signals are green during each simulation interval. CORSIM is set up to run in one second time steps, therefore the CORSIM environment must be clocked to run at exactly one Hz.

Replacing the CORSIM simulated controller with an actual traffic signal controller is referred to as "hardware-in-the-loop" testing. However, in order to provide this capability for traffic signal systems it is necessary to develop an I/O subsystem that can easily interface to CORSIM. Since it is desirable to have a portable and scalable system, a serial-based I/O subsystem was selected because it could be run on an ordinary notebook computer with an RS-232 port without having to plug in specialized interface boards. FIG. 2 shows the basic configuration of the hardware-in-the-loop simulation. On the left side of FIG. 2 are three NEMA traffic signal controllers ($S_1$, $S_2$, $S_3$) corresponding to three intersections. All of these controllers are networked together in network 10 and connected back to notebook computer 14 running the traffic signal vendor's closed loop signal software as in the prior art. On the right side of FIG. 2, three controller interface devices (CIDs) of the present invention ($CID_1$, $CID_2$, $CID_3$) are shown networked together in network 12 and connected to a second notebook computer. This CID network is the means that allows CORSIM to send the simulated vehicle detector information out to the individual controllers and receive back phase indications. Computer 16 runs the CORSIM network simulation.

The CORSIM environment interfaces to the CID network by a simple RS-232 line 18 connected to the first CID. The first CID ($CID_1$) converts that RS-232 signal into an RS-422 signal in line 20 by means of converter 19 (part number 422 NOICR from B&B Electronics of Ottawa, IL) so that several CIDs can be multidropped from the same serial link. Each of the CIDs is assigned a unique numeric identifier corresponding to the number assigned to the intersection node in CORSIM.

Each CID includes a set of Opto-22 SNAP I/O modules made by Opto-22 of Temecula, Calif. which serve to prevent the transmission of possible "spikes" in the output of signal controllers $S_1$–$S_3$ to computer 16 through optical isolation, as is well known in the art. These SNAP I/O modules comprise an input side 23 and an output side 22. These modules also convert the RS-422 signal to a 24 volt DC signal within each CID which is then sent to AMP connectors 24, each of which is connected to a plurality of individual wires. From there the wires go into a traffic signal controller by means of cables 26. Cables 26 are shown as having 4 lines on the left and 2 lines on the right. In reality, each line consists of a plurality of individual wires; the wires are in 2 bundles coming out of the CIDs and are in 4 bundles going into the traffic signal controllers.

Each traffic signal controller typically has a set of 4 NEMA connectors 28–34 which are, respectively, NEMA A, B, C, and D connectors. Connectors 28–32 are standard NEMA connectors (see NEMA standard TS-1) having 55 to 65 pins; connector 34 is used in the present invention to interface to non-standard functions such as preemption. However, the pins in connector 34 are not standard and special cables need to be made for each vendor's controller. Some of the pins are outputs that indicate the phase of the controller (i.e. whether it is red, yellow, or green). Other pins are inputs that give the controller information on which streets have vehicles waiting or arriving at the intersection, either at a red light or are at a green light. The traffic signal controllers are networked together and with computer 14, which runs the controller manufacturer's proprietary software, by means of modems 36 provided by the manufacturers.

Using the arrangement shown in FIG. 2, CORSIM can be used to model almost any signalized arterial and/or urban grid. Instead of using the controllers's internal control algorithms, CORSIM sends detector actuation signals out to the traffic signal controllers every one second and reads back the corresponding phase indications. The existing microscopic simulations continue to function unchanged. This allows engineers to collect and tabulate the various MOEs that CORSIM produces.

In operation, CORSIM, running on computer 16, simulates whatever traffic flow is input into it (i.e. morning rush hour, afternoon, evening rush hour, etc.). Vehicle detectors in each street that is being simulated generate either a presence signal (NEMA TS 2, Section 6.5.2.17.10) or a pulse signal (NEMA TS 2 Section 6.5.2.12.2). As is well known in the industry, "presence" means that the loop detector continues to indicate that the vehicle is present as long as it remains over the loop detector. Similarly, "pulse" means that a pulse that is nominally 100–150 milliseconds in width is generated every time a vehicle enters the loop. These detector states are transmitted via RS 232 line 18 to RS 232/RS 422 converter 19. RS 422 network cable 20 connects with Opto 22 brainboard 21 which controls Snap I/O output module 22. When CORSIM instructs output modules 22 that there is a pulse or presence detector actuation, they close the appropriate digital relay for the prescribed time duration. Controllers $S_1$, $S_2$, and S3 "see" this contact closure via cables 26. Based upon the observed detector states and parameters programmed into controllers $S_1$, $S_2$, and $S_3$ the controllers update the state of their output phase indications each cycle.

These phase indications on traffic signal controllers $S_1$–$S_3$ are transmitted back to Opto 22 Snap I/O input modules 23 via cable 26. That sensed state is read by the Opto 22 brainboards 21 and is available to CORSIM in a computer readable the next time it polls $CID_1$–$CID_3$ for the state of the phase indications.

Depending on the state of the phases (green, amber, or red) CORSIM decides which vehicles should be moving, accelerating, or decelerating and updates their position and velocity using standard kinematic equations. It then updates all its internal tables and waits for the next simulation interval. Once the simulation period has been completed (typically 20 to 40 minutes, but sometimes several hours depending on input conditions) CORSIM tabulates and summarizes the MOEs. Also, while running CORSIM generates a binary file describing the second by second position of every vehicle and all signal indications during the entire simulation period. That file can either be viewed concurrently during the simulation or after the simulation is complete, in order to diagnose traffic flow problems disclosed by the simulation.

Obviously the above simulation can be run with a program other than CORSIM. It can also include features such as railroad crossing preempts, emergency vehicle preempts, transit preempts, pedestrian crosswalk buttons, and other situations that traffic encounters in real life.

The simulation program also need not model a street network. It may by simply programmed to generate a prescribed deterministic sequence of outputs to verify that the controller responds correctly within a specified time period. This would allow for automating the testing of specific controller features.

I claim:

1. In a laboratory simulation of traffic including an actual traffic signal controller and a computer for simulating traffic flow at an intersection, a controller interface device for adapting traffic signal controller input signals generated by said computer for use by said traffic signal controller comprising means for receiving computer-generated signals representative of desired traffic signal controller input signals, means for converting said computer-generated signals into electrical signals, means for directing said electrical signals into said traffic signal controller, means for receiving the response of said traffic signal controller to said electrical signals, and means for sending said response of said traffic signal controller back into said computer.

2. A controller interface device as in claim 1 wherein said response of said traffic signal controller is converted to computer readable format.

3. In the method of simulating traffic flow at an intersection having a traffic signal control device by running a traffic simulation program in a computer, the improvement which comprises providing such a traffic signal control device, providing means for sending computer-generated control signals to said traffic signal control device, providing means for sending the response of said traffic signal control device to said computer-generated signals back to said computer, and integrating said response of said traffic signal control device into said traffic simulation program.

4. The method of claim 3 further including converting said computer-generated signals into electrical signals before sending them back into said traffic signal control device.

5. The method of claim 4 further including converting said response of said traffic signal control device to said computer-generated signals into computer readable format.

* * * * *